US009415905B1

(12) United States Patent
Gilliam

(10) Patent No.: US 9,415,905 B1
(45) Date of Patent: Aug. 16, 2016

(54) PRY-OFF TAMPER EVIDENT CROWN CAP SYSTEM

(76) Inventor: James R. Gilliam, Clearwater, FL (US)

( * ) Notice: Subject to any disclaimer, the term of this patent is extended or adjusted under 35 U.S.C. 154(b) by 260 days.

(21) Appl. No.: 13/405,910

(22) Filed: Feb. 27, 2012

Related U.S. Application Data

(63) Continuation-in-part of application No. 12/387,618, filed on May 5, 2009, now abandoned.

(51) Int. Cl.
*B65D 41/28* (2006.01)
*B65D 41/12* (2006.01)
*B67B 7/16* (2006.01)

(52) U.S. Cl.
CPC ..... *B65D 41/28* (2013.01); *B65D 41/125* (2013.01); *B65D 2543/00425* (2013.01); *B67B 7/16* (2013.01)

(58) Field of Classification Search
CPC ..... B65D 41/10; B65D 41/105; B65D 41/12; B65D 41/125; B65D 41/28; B65D 2543/0042; B67B 7/165
USPC ..... 215/253, 255, 328, 329, 336, 337, 341, 215/348, 232; 220/359.1; 81/3.07, 3.55
See application file for complete search history.

(56) References Cited

U.S. PATENT DOCUMENTS

| | | | | |
|---|---|---|---|---|
| 2,581,647 | A * | 1/1952 | Genovese | 215/328 |
| 3,246,784 | A * | 4/1966 | Scharf et al. | 215/251 |
| 3,273,736 | A * | 9/1966 | Lister et al. | 215/352 |
| 3,410,436 | A * | 11/1968 | Foss et al. | 215/253 |
| 3,462,036 | A * | 8/1969 | Siemonsen et al. | 215/255 |
| 4,126,244 | A * | 11/1978 | Elser | 220/268 |
| 4,452,365 | A * | 6/1984 | Ascasibar-Verdejo | 215/346 |
| 4,562,930 | A * | 1/1986 | Lecinski, Jr. et al. | 215/44 |
| 4,854,856 | A * | 8/1989 | Steiger Jr., et al. | 431/253 |
| 7,285,583 | B2 * | 10/2007 | Stumphauzer et al. | 523/201 |
| 2004/0074863 | A1 * | 4/2004 | Ramsey et al. | 215/327 |

* cited by examiner

*Primary Examiner* — James N Smalley

(57) ABSTRACT

A crown cap is adapted to be removably coupled to a bottle. The crown cap has a circular central region and a downwardly extending side wall in a generally cylindrical configuration. The side wall has an inwardly scrolled lower edge. The central region of the crown cap radially terminates in an upwardly extending exterior projection. The crown cap has a downwardly extending interior projection radially interior of the exterior projection. An adhesive is provided in the exterior projection.

1 Claim, 2 Drawing Sheets

FIG. 1
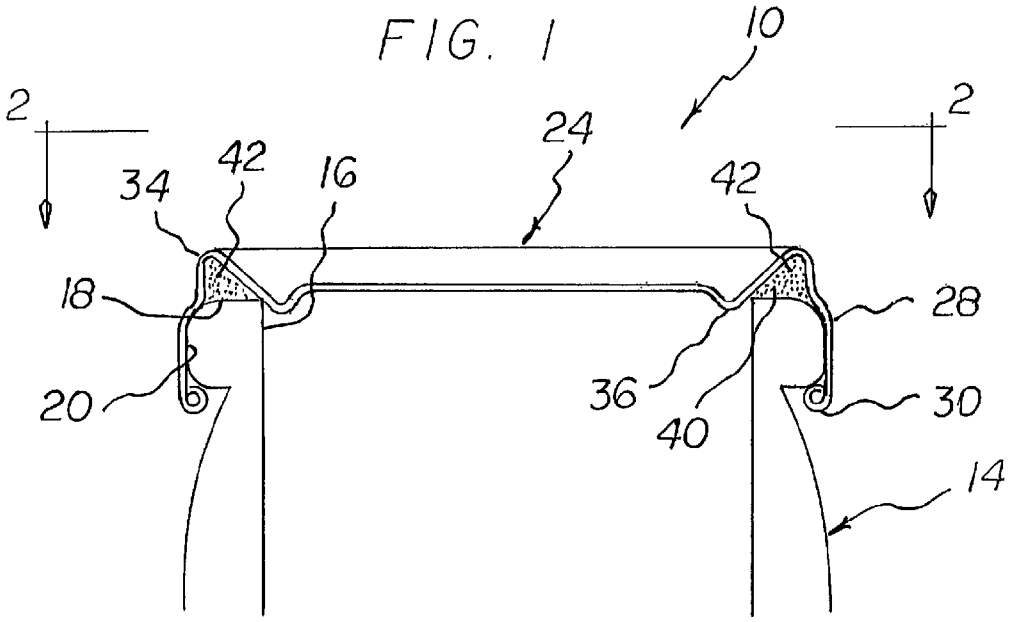
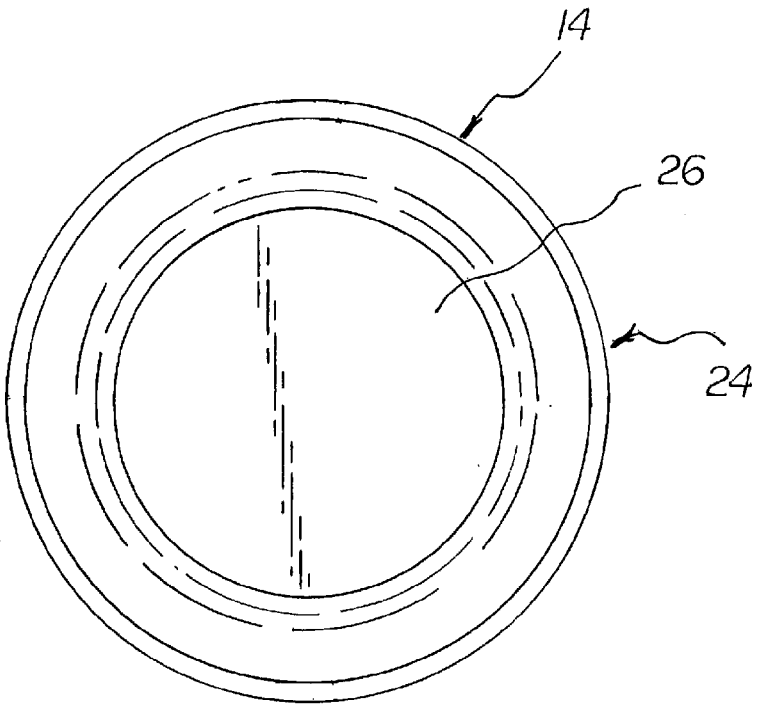
FIG. 2

FIG. 3
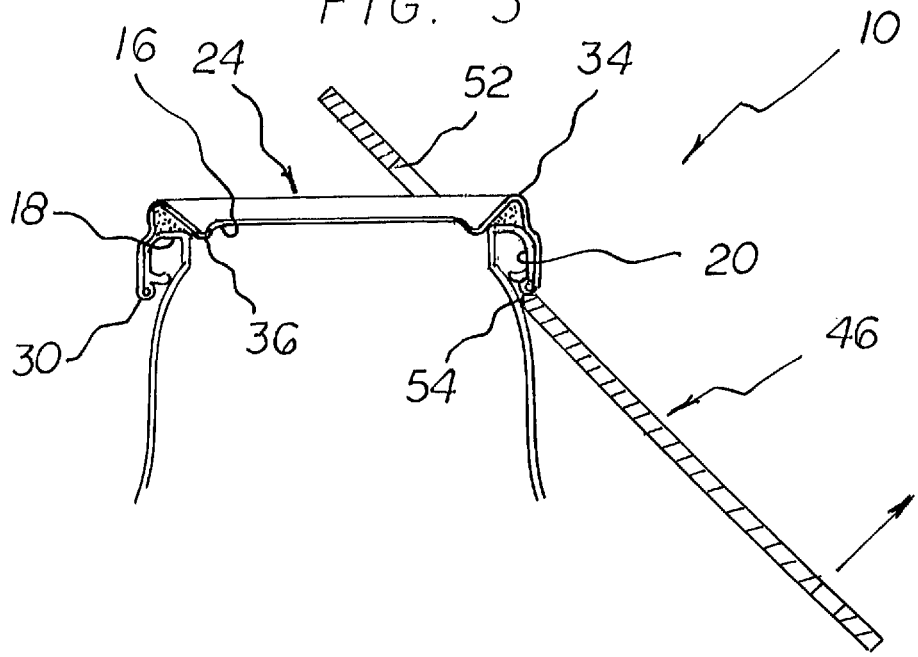
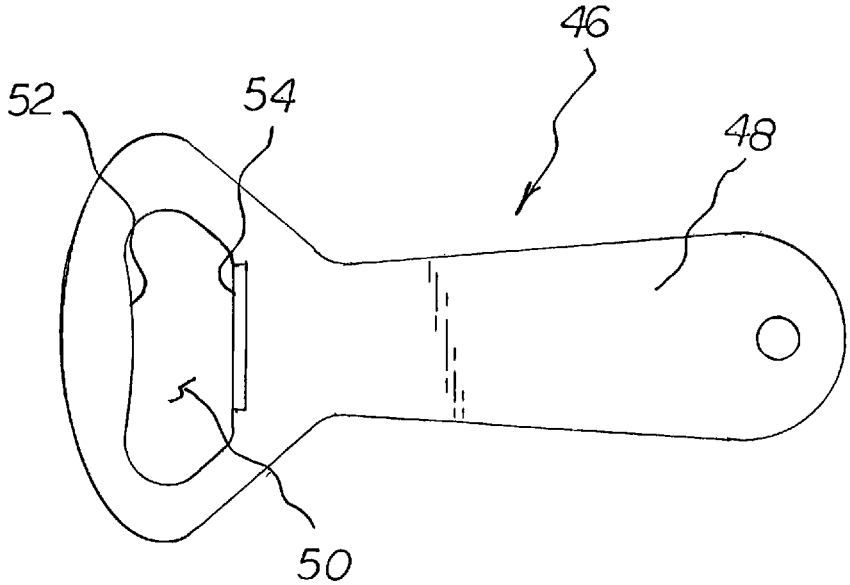
FIG. 4

PRY-OFF TAMPER EVIDENT CROWN CAP SYSTEM

RELATED APPLICATION

This patent application is a continuation-in-part of U.S. patent application Ser. No. 12/387,618 filed May 5, 2009, the subject matter of which is incorporated herein by reference.

BACKGROUND OF THE INVENTION

Field of the Invention

The present invention relates to a pry-off tamper evident crown cap system and more particularly pertains to attaching a crown cap to a bottle and for the removal thereof, such attaching and removing being done in a safe, ecological, convenient and economical manner.

SUMMARY OF THE INVENTION

In view of the disadvantages inherent in the known types of cap systems of known designs and configurations now present in the prior art, the present invention provides an improved pry-off tamper evident crown cap system. As such, the general purpose of the present invention, which will be described subsequently in greater detail, is to provide a new and improved pry-off tamper evident crown cap system and method which has all the advantages of the prior art and none of the disadvantages.

To attain this, the present invention essentially comprises a pry-off tamper evident crown cap system. First provided is a bottle. The bottle is provided to contain a liquid. The bottle has a generally cylindrical body. The bottle has an open top. The open top has a circular lip. The open top has an axially spaced outwardly projection. The projection is provided below the lip. The lip is in a horizontal plane. The lip is provided at an elevation above a plane containing the outwardly extending projection. The bottle is fabricated of a non-corrosive material. The non-corrosive material is selected from the class of non-corrosive materials. The class of non-corrosive materials includes glass, plastic, and aluminum.

A crown cap is provided. The crown cap is removably attached to the bottle. The crown cap has a circular central region. The crown cap has a downwardly extending side wall. The side wall is in a generally cylindrical configuration. The side wall has an inwardly scrolled lower edge. The central region of the crown cap radially terminates in an upwardly extending inverted V-shaped projection. The projection is positionable above the lip of the bottle. The crown cap has a downwardly extending U-shaped projection. The projection is provided radially interior of the V-shaped projection. The projection is positionable in the bottle. The crown cap is fabricated of a non-corrosive aluminum.

The crown cap when removably attached to the bottle is positioned over and covers the top of the bottle. The inverted V-shaped projection is located above the lip of the bottle. The U-shaped projection is located in the bottle radially inward of the lip of the bottle. The side wall of the crown cap is crimped. In this manner the scrolled lower edge of the crown cap is beneath and in continuous contact with a lower extent of the outwardly extending projection of the bottle tamper-secure lock. Also in this manner increased body strength is provided to the crown cap.

The crown cap is adapted to be inverted prior to being crimped and coupled to the bottle. The inverted V-shaped projection thereby forms an annular trough. A chlorine-free hot melt adhesive is provided in the trough. The hot melt adhesive is chosen from the class of hot melt adhesives. The hot melt adhesives include chlorine-free plastic and rubber, natural and synthetic, and blends thereof. The hot melt adhesive is adapted to form a seal between the bottle and the crown cap.

Provided last is an opener. The opener has a handle. The handle is provided below. The opener has an opening. The opening is provided above. The opening has an exterior edge. The exterior edge is positionable in contact with the crown cap at locations spanning the central region of the crown cap. The opener also forms an interior edge. The interior edge is positionable beneath the scrolled lower edge of the crown cap. In this manner lifting the handle will break the scrolled lower edge and lift the crown cap from the bottle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pry-off tamper evident crown cap system which has all of the advantages of the prior art xother and none of the disadvantages.

It is another object of the present invention to provide a new and improved pry-off tamper evident crown cap system which may be easily and efficiently manufactured and marketed.

It is further object of the present invention to provide a new and improved pry-off tamper evident crown cap system which is of durable and reliable constructions.

An even further object of the present invention is to provide a new and improved pry-off tamper evident crown cap system which is susceptible of a low cost of manufacture with regard to both materials and labor, and which accordingly is then susceptible of low prices of sale to the consuming public, thereby making such pry-off tamper evident crown cap system economically available to the buying public.

Even still another object of the present invention is to provide a pry-off tamper evident crown cap system for attaching a crown cap to a bottle and for the removal thereof, such attaching and removing being done in a safe, ecological, convenient and economical manner.

Lastly, it is an object of the present invention to provide a new and improved pry-off tamper evident crown cap system. A crown cap is adapted to be removably coupled to a bottle.

The crown cap has a circular central region and a downwardly extending side wall in a generally cylindrical configuration. The side wall has an inwardly scrolled lower edge. The central region of the crown cap radially terminates in an upwardly extending exterior projection. The crown cap has a downwardly extending interior projection radially interior of the exterior projection. An adhesive is provided in the exterior projection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a cross sectional view of a pry-off tamper evident crown cap system on a bottle constructed in accordance with the principles of the present invention FIG. 2 is a plan view of the system taken along line 2-2 of FIG. 1.

FIG. 3 is a cross sectional view of the system illustrated in FIGS. 1 and 2 with an associated opener.

FIG. 4 is a plan view of the opener shown in FIG. 3 prior to positioning on a crown cap for removing the crown cap from the bottle.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved pry-off tamper evident crown cap system embodying the principles and concepts of the present invention and generally designated by the reference numeral 10 will be described.

The present invention, the pry-off tamper evident crown cap system 10 is comprised of a crown cap configured and correlated with respect to each other so as to attain the desired objective.

First provided is a bottle 14. The bottle is provided to contain a liquid. The bottle has a generally cylindrical body. The bottle has an open top 16. The open top has a circular lip 18. The open top has an axially spaced outwardly projection 20. The projection is provided below the lip. The lip is in a horizontal plane. The lip is provided at an elevation above a plane containing the outwardly extending projection. The bottle is fabricated of a non-corrosive material. The non-corrosive material is selected from the class of non-corrosive materials. The class of non-corrosive materials includes glass, plastic, and aluminum.

A crown cap 24 is provided. The crown cap is removably attached to the bottle. The crown cap has a circular central region 26. The crown cap has a downwardly extending side wall 28. The side wall is in a generally cylindrical configuration. The side wall has an inwardly scrolled lower edge 30. The central region of the crown cap radially terminates in an upwardly extending inverted V-shaped projection 34. The projection is positionable above the lip of the bottle. The crown cap has a downwardly extending U-shaped projection 36. The projection is provided radially interior of the V-shaped projection. The projection is positionable in the bottle. The crown cap is fabricated of a non-corrosive aluminum.

The crown cap when removably attached to the bottle is positioned over and covers the top of the bottle. The inverted V-shaped projection is located above the lip of the bottle. The U-shaped projection is located in the bottle radially inward of the lip of the bottle. The side wall of the crown cap is crimped. In this manner the scrolled lower edge of the crown cap is beneath and in continuous contact with a lower extent of the outwardly extending projection of the bottle tamper-secure lock. Also in this manner increased body strength is provided to the crown cap.

The crown cap is adapted to be inverted prior to being crimped and coupled to the bottle. The inverted V-shaped projection thereby forms an annular trough 40. A chlorine-free hot melt adhesive 42 is provided in the trough. The hot melt adhesive is chosen from the class of hot melt adhesives. The hot melt adhesives include chlorine-free plastic and rubber, natural and synthetic, and blends thereof. The hot melt adhesive is adapted to form a seal between the bottle and the crown cap.

Provided last is an opener 46. The opener has a handle 48. The handle is provided below. The opener has an opening 50. The opening is provided above. The opening has an exterior edge 52. The exterior edge is positionable in contact with the crown cap at locations spanning the central region of the crown cap. The opener also forms an interior edge 54. The interior edge is positionable beneath the scrolled lower edge of the crown cap. In this manner lifting the handle will break the scrolled lower edge and lift the crown cap from the bottle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pry-off tamper evident crown cap system (10) for attaching a crown cap to a bottle and for the removal thereof, such attaching and removing being done in a safe, ecological, convenient and economical manner, the system comprising, in combination:

a bottle (14) for containing a liquid, the bottle being formed with a generally cylindrical body and an open top (16), the open top being formed with a circular lip (18) and an axially spaced outwardly extending projection (20) below the lip, the lip being in a horizontal plane at an elevation above a plane containing the outwardly extending projection, the bottle being fabricated of a non-corrosive material selected from the class of non-corrosive materials including glass, plastic, and aluminum;

a crown cap (24) removably attached to the bottle, the crown cap having a circular central region (26) and a downwardly extending side wall (28) in a generally cylindrical configuration, the side wall having an inwardly scrolled lower edge (30), the central region of the crown cap radially terminating in an upwardly extending inverted V-shaped projection (34) positionable above the lip of the bottle, the crown cap having a downwardly extending U-shaped projection (36) radially interior of the V-shaped projection and positionable in the bottle, the crown cap being fabricated of a non-corrosive aluminum;

the crown cap when removably attached to the bottle being positioned over and covering the top of the bottle with the inverted V-shaped projection located above the lip of the bottle and the U-shaped projection located in the bottle radially inward of the lip of the bottle, the side wall of the crown cap being crimped whereby the scrolled lower edge of the crown cap is beneath and in continuous contact with a lower extent of the outwardly extending projection of the bottle to form a tamper-secure lock and to provide increased body strength to the crown cap;

the crown cap adapted to be inverted prior to being crimped and coupled to the bottle, the inverted V-shaped projection thereby forming an annular trough (40) with a chlorine-free hot melt adhesive (42) in the trough, the hot melt adhesive being chosen from the class of hot melt adhesives including chlorine-free plastic and rubber, natural and synthetic, and blends thereof, the hot melt adhesive adapted to form a seal between the bottle and the crown cap; and an opener (46) having a handle (48) below and an opening (50) above, the opening formed with an exterior edge (52) positionable in contact with the crown cap at locations spanning the central region of the crown cap, the opener also formed with an interior edge (54) positionable beneath the scrolled lower edge of the crown cap whereby lifting the handle will break the scrolled lower edge and lift the crown cap from the bottle.

* * * * *